US007708841B2

(12) United States Patent
Saller et al.

(10) Patent No.: US 7,708,841 B2
(45) Date of Patent: May 4, 2010

(54) COMPONENT FOR USE IN OIL FIELD TECHNOLOGY MADE OF A MATERIAL WHICH COMPRISES A CORROSION-RESISTANT AUSTENITIC STEEL ALLOY

(75) Inventors: Gabriele Saller, Leoben (AT); Herbert Aigner, Buchbach (AT); Josef Bernauer, St. Florian (AT); Raimund Huber, Kapfenberg (AT)

(73) Assignees: Boehler Edelstahl GmbH & Co KG, Kapfenberg (AT); Schoeller-Bleckmann Oilfield Technology GmbH, Temitz (AT)

( * ) Notice: Subject to any disclaimer, the term of this patent is extended or adjusted under 35 U.S.C. 154(b) by 623 days.

(21) Appl. No.: 11/001,061

(22) Filed: Dec. 2, 2004

(65) Prior Publication Data

US 2005/0145308 A1 Jul. 7, 2005

(30) Foreign Application Priority Data

Dec. 3, 2003 (AT) ..... A 1938/2003

(51) Int. Cl.
*C22C 38/58* (2006.01)

(52) U.S. Cl. ..... 148/327; 148/329; 148/442; 148/620; 148/608; 148/609; 148/610; 148/611; 420/46; 420/47; 420/45; 420/57; 420/58; 420/59; 420/73; 420/74; 420/586.1

(58) Field of Classification Search ..... 420/56–59, 420/46–47, 72–76, 586.1, 44, 45; 148/327, 148/329, 442, 620, 648–654, 608–611
See application file for complete search history.

(56) References Cited

U.S. PATENT DOCUMENTS

| | | | | |
|---|---|---|---|---|
| 3,820,980 | A | 6/1974 | Hartline, III | |
| 3,847,599 | A | 11/1974 | Hartline, III | |
| 3,880,654 | A | 4/1975 | Hartline, III | |
| 3,936,297 | A | 2/1976 | Harltine, III | |
| 3,938,990 | A | 2/1976 | Hartline, III | |
| 4,217,136 | A | 8/1980 | Hartline, III | |
| 4,493,733 | A | 1/1985 | Yamamoto et al. | |
| 4,919,728 | A | 4/1990 | Kohl et al. | |
| 5,308,577 | A * | 5/1994 | Dulmaine et al. | 420/57 |
| 6,454,879 | B1 | 9/2002 | Aigner et al. | 148/306 |

FOREIGN PATENT DOCUMENTS

| | | | |
|---|---|---|---|
| AT | 387309 | | 3/1989 |
| AT | 407882 | | 7/2001 |
| DE | 3940438 | | 5/1991 |
| DE | 19607828 | | 10/1996 |
| DE | 19758613 | | 10/1998 |
| EP | 0207068 | | 12/1986 |
| EP | 0249117 | | 12/1987 |
| EP | 0432434 | | 6/1991 |
| FR | 2493344 | | 7/1982 |
| GB | 2108888 | | 11/1981 |
| JP | 59-205451 | * | 11/1984 |
| JP | 362109951 | * | 5/1987 |
| JP | 06-116683 | | 4/1994 |
| JP | 07-062432 | | 3/1995 |

OTHER PUBLICATIONS

English Language Abstract of AT 387309.
English Language Abstract of FR 2493344.
English Language Abstract of JP 07-062432.
English Language Abstract of DE 19758613.
English Language Abstract of JP 06-116683.
English Language Abstract of EP 0432434.
English Language Abstract of DE 39 40 438.
English Language Abstract of DE 196 07 828.
Sedriks, A.J. "Corrosion of Stainless Steels", John Wiley & Sons, Inc., New York, 2nd edition, 1996, pp. 272-279.
ASTM Designation: G36-94 (Reapproved 2000) "Standard Practice for Evaluating Stress-Corrosion-Cracking Resistance of Metals and Alloys in a Boiling Magnesium Chloride Solution", American Society for Testing and Materials, West Consohocken, PA, 2000, pp. 134-139.
English translation of JP 59-205451. , Rikio Nemoto et al. Nov. 21, 1984.

* cited by examiner

*Primary Examiner*—Deborah Yee
(74) *Attorney, Agent, or Firm*—Greenblum & Bernstein, P.L.C.

(57) ABSTRACT

An austenitic, substantially ferrite-free steel alloy and a process for producing components therefrom. This Abstract is not intended to define the invention disclosed in the specification, nor intended to limit the scope of the invention in any way.

59 Claims, No Drawings

COMPONENT FOR USE IN OIL FIELD TECHNOLOGY MADE OF A MATERIAL WHICH COMPRISES A CORROSION-RESISTANT AUSTENITIC STEEL ALLOY

CROSS-REFERENCE TO RELATED APPLICATIONS

The present invention claims priority under 35 U.S.C. § 119 of Austrian Patent Application No. A 1938/2003, filed Dec. 3, 2003, the disclosure of which is expressly incorporated by reference herein in its entirety.

BACKGROUND OF THE INVENTION

1. Field of the Invention

The present invention relates to an austenitic, substantially ferrite-free steel alloy and the use thereof. The invention also relates to a method for producing austenitic, substantially ferrite-free components, in particular drill rods for oilfield technology.

2. Discussion of Background Information

When sinking drill holes, e.g., in oilfield technology, it is necessary to establish a drill hole path as exactly as possible. This is usually done by determining the position of the drill head with the aid of magnetic field probes in which the earth's magnetic field is utilized for measuring. Parts of drill rigs, in particular drill rods, are therefore made of non-magnetic alloys. In this connection, a relative magnetic permeability $\mu_r$ of less than 1.01 is required today, at least for those parts of drilling strings that are located in the direct vicinity of magnetic field probes.

Austenitic alloys can be substantially ferrite-free, i.e., with a relative magnetic permeability $\mu_r$ of less than about 1.01. Austenitic alloys can thus meet the above requirement and therefore be used in principle for drilling string components.

In order to be suitable for use in the form of drilling string components, in particular for deep-hole drillings, it is further necessary for an austenitic material to exhibit minimal values of certain mechanical properties, in particular of the 0.2% yield strength and the tensile strength, and to be able to withstand the dynamically varying stresses that occur during a drilling operation, in addition to having a high fatigue strength under reversed stresses. Otherwise, e.g., drill rods made of corresponding alloys cannot withstand the high tensile and pressure stresses and torsional stresses that occur during use or can withstand them only for a short time in use; undesirably rapid or premature material failure is the result.

As a rule, austenitic materials for drilling string components are highly alloyed with nitrogen in order to achieve high values of the yield strength and tensile strength of components such as drill rods. However, one requirement to be taken into consideration is a freedom from porosity of the material used, which freedom from porosity can be influenced by the alloy composition and production method.

In this regard, economically favorable alloys naturally are alloys which upon solidification under atmospheric pressure result in pore-free semi-finished products. However, in practice, such austenitic alloys are rather rare because of the high nitrogen content, and in order to achieve a freedom from porosity a solidification under increased pressure is consistently necessary. A melting and solidification under nitrogen pressure can also be necessary in order to incorporate sufficient nitrogen in the solidified material, if otherwise there is an insufficient nitrogen solubility.

Finally, austenitic alloys that are provided for use as components of drilling strings should have a good resistance to different types of corrosion. In particular a high resistance to pitting corrosion and stress corrosion cracking is desirable, above all in chloride-containing media.

According to the prior art, austenitic alloys are known which each meet some of these requirements, namely being substantial ferrite-free, having good mechanical properties, being free of pores and exhibiting a high corrosion resistance.

Articles made of a hot-worked and cold-worked austenitic material with (in % by weight) max. 0.12% of carbon, 0.20% to 1.00% of silicon, 17.5% to 20.0% of manganese, max. 0.05% of phosphorus, max. 0.015% of sulfur, 17.0% to 20.0% of chromium, max. 5% of molybdenum, max. 3.0% of nickel, 0.8% to 1.2% of nitrogen which material is subsequently aged at temperatures of above 300° C. are known from DE 39 40 438 C1. However, as noted by some of the same inventors in DE 196 07 828 A1, these articles have modest fatigue strength under reversed stresses of at best 375 MPa, which fatigue strength is much lower still in an aggressive environment, e.g., in saline solution.

Another austenitic alloy is known from DE 196 07 828 A1, mentioned above. According to this document, articles are proposed for the offshore industry which are made of an austenitic alloy with (in % by weight) 0.1% of carbon, 8% to 15% of manganese, 13% to 18% of chromium, 2.5% to 6% of molybdenum, 0% to 5% of nickel and 0.55% to 1.1% of nitrogen. Such articles are reported to have high mechanical characteristics and a higher fatigue strength under reversed stresses than articles according to DE 39 40 438 C1. However, one disadvantage thereof is a low nitrogen solubility that is attributable to the alloy composition, which is why melting and solidification have to be carried out under pressure, or still more burdensome powder metallurgical production methods have to be used.

An austenitic alloy which results in articles with low magnetic permeability and good mechanical properties with melting at atmospheric pressure is described in AT 407 882 B. Such an alloy has in particular a high 0.2% yield strength, a high tensile strength and a high fatigue strength under reversed stresses. Alloys according to AT 407 882 B are expediently hot worked and subjected to a second forming at temperatures of 350° C. to approx. 600° C. The alloys are suitable for the production of drill rods which also adequately take into account the high demands with respect to static and dynamic loading capacity over long operating periods within the scope of drill use in oilfield technology.

Nevertheless, as was ascertained, material failure can occur because during use drilling string components such as drill rods are subjected to highly corrosive media at high temperatures and additionally are subjected to high mechanical stresses. Consequently, stress corrosion cracking can occur. Since drill rods and other parts of drill installations may also be in contact with corrosive media during down time, pitting corrosion can likewise contribute substantially to material failure. In practice, both types of corrosion cause a shortening of the maximum theoretical working life or operational time of drill rods that one would expect based on the mechanical properties or characteristics.

The known alloys discussed above show that highly nitrogenous austenitic alloys which can be melted under atmospheric pressure to form at least substantially pore-free ingots do not meet the requirements of good mechanical properties and at the same time high resistance to corrosion during tensile and compressive stress and high resistance to pitting corrosion in a satisfactory manner.

It would be advantageous to have available an austenitic steel alloy which can be melted at atmospheric pressure and processed to form pore-free semi-finished products and which at the same time has a high resistance to stress-corrosion cracking and to pitting corrosion with good mechanical properties, in particular with a high 0.2% yield strength, a high tensile strength and a high fatigue strength under reversed stresses. It would also be advantageous to have available an austenitic, substantially ferrite-free alloy.

SUMMARY OF THE INVENTION

The present invention provides an austenitic, substantially ferrite-free steel alloy. This alloy comprises, in % by weight:

from about 0% to about 0.35% of carbon
from about 0% to about 0.75% of silicon
from more than about 19.0% to about 30.0% of manganese
from more than about 17.0% to about 24.0% of chromium
from more than about 1.90% to about 5.5% of molybdenum
from about 0% to about 2.0% of tungsten
from about 0% to about 15.0% of nickel
from about 0% to about 5.0% of cobalt
from about 0.35% to about 1.05% of nitrogen
from about 0% to about 0.005% of boron
from about 0% to about 0.30% of sulfur
from about 0% to less than about 0.5% of copper
from about 0% to less than about 0.05% of aluminum
from about 0% to less than about 0.035% of phosphorus, the total content of nickel and cobalt being greater than about 2.50%, and optionally one or more elements selected from vanadium, niobium and titanium in a total concentration of not more than about 0.85%, balance iron and production-related impurities.

The weight percentages given in the present specification and in the appended claims are based on the total weight of the alloy. Also, unless otherwise indicated, all percentages of elements given herein and in the appended claims are by weight.

In one aspect, the alloy of the present invention may comprise at least about 2.65% of nickel, e.g., at least about 3.6% of nickel, or from about 3.8% to about 9.8% of nickel.

In another aspect, the alloy may comprise not more than about 0.2% of cobalt.

In yet another aspect, the alloy may comprise from about 2.05% to about 5.0% of molybdenum, e.g., from about 2.5% to about 4.5% of molybdenum.

In a still further aspect, the alloy may comprise from more than about 20.0% to about 25.5% of manganese and/or the alloy may comprise from about 19.0% to about 23.5% of chromium, e.g., from about 20.0% to about 23.0% of chromium.

In another aspect, the alloy may comprise from about 0.15% to about 0.30% of silicon and/or from about 0.01% to about 0.06% of carbon and/or from about 0.40% to about 0.95% of nitrogen, e.g., from about 0.60% to about 0.90% of nitrogen.

In another aspect of the alloy of the present invention, the weight ratio of nitrogen to carbon may be greater than about 15.

In yet another aspect, the alloy may comprise from about 0.04% to about 0.35% of copper and/or from about 0.0005% to about 0.004% of boron.

In a still further aspect, the concentration of nickel may be about equal to or greater than the concentration of molybdenum. For example, the concentration of nickel may be greater than about 1.3 times, e.g., greater than about 1.5 times the concentration of molybdenum.

In another aspect, the alloy may comprise at least two elements selected from vanadium, niobium and titanium in a total concentration of from higher than about 0.08% to lower than about 0.45%.

In another aspect, the alloy may comprise not more than about 0.015% of sulfur and/or not more than about 0.02% of phosphorus.

In yet another aspect, the alloy of the present invention may comprise molybdenum and tungsten in concentrations such that X=[(% molybdenum)+0.5*(% tungsten)] and about 2<X<about 5.5.

In yet another aspect, the alloy may have a fatigue strength under reversed stresses at room temperature of greater than about 400 MPa at $10^7$ load alternation.

In a still further aspect, the alloy may be substantially free of nitrogenous precipitations and/or carbide precipitations.

In another aspect, the alloy may have been hot worked at a temperature of higher than about 750° C., optionally solution-annealed and subsequently formed at a temperature below the recrystallization temperature, e.g., at a temperature below about 600° C. For example, the alloy may have been formed at a temperature of from about 300° C. to about 550° C.

The present invention also provides a component for use in oilfield technology, e.g., a drilling string part, which component comprises the alloy of the present invention, including the various aspects thereof. Also provided by the present invention is a component for use under tensile and compressive stresses in a corrosive fluid (e.g., saline water), which component comprises the alloy of the present invention, including the various aspects thereof.

The present invention also provides a process for producing an austenitic, substantially ferrite-free component. This process comprises:

(a) providing a cast piece of an alloy according to the present invention, including the various aspects thereof,
(b) forming the cast piece at a temperature of above about 750° C. into a semi-finished product in two or more hot working partial operations,
(c) subjecting the semi-finished product to intensified cooling,
(d) forming the cooled semi-finished product at a temperature below the recrystallization temperature, and
(e) converting the semi-finished product into the component by a process which comprises machining.

In one aspect of the process, a homogenization of the semi-finished product at a temperature of above about 1150° C. may be carried out before a first hot working partial operation and/or between two subsequent hot working partial operations.

In another aspect of the process, a solution annealing of the semi-finished product at a temperature of above about 900° C. may be carried out after the last hot working partial operation.

In yet another aspect, (d) may be carried out at a temperature of below about 600° C. and/or above about 350° C.

In a still further aspect, the semi-finished product may comprise a rod. For example, the rod may be formed in (d) with a deformation degree of from about 10% to about 20%.

In another aspect, the cast piece may be produced by a process which comprises an electroslag remelting process.

In yet another aspect of the process of the present invention, the machining may comprise a turning and/or a peeling.

The advantages associated with the present invention include that an austenitic, essentially ferrite-free steel alloy is provided which has good mechanical properties, in particular high values of the 0.2% yield strength and the tensile strength and which at the same time has a high resistance to stress corrosion cracking as well as to pitting corrosion.

A high nitrogen solubility is provided due to a synergistically coordinated alloying composition. An at least substantially pore-free ingot can thus be advantageously produced from an alloy according to the invention with melting and solidifying under atmospheric pressure.

After a hot working of a cast piece in one or more steps, an optional subsequent solution annealing of the semi-finished product and a subsequent further forming at a temperature below the recrystallization temperature, preferably below about 600° C., in particular in the range of about 300° C. to about 550° C., a material according to the invention is available that is essentially free of nitrogenous and/or carbide precipitations. This affords a high fatigue strength under reversed stresses of the same, because substantially the entire nitrogen is present in solution and, e.g., carbides, which act as micro-grooves, are greatly reduced. Accordingly, an article made of the alloy according to the invention preferably has a fatigue strength under reversed stresses at room temperature of more than about 400 MPa at a $10^7$ load alternation.

On the other hand, being substantially free of nitrogenous and/or carbide precipitations generally result in a high corrosion resistance of the steel because above all chromium and molybdenum are not bonded as carbides and/or nitrides and therefore develop their passivation effect all over with respect to corrosion resistance. Parts made of steel alloys according to the invention with better mechanical properties can thus have a resistance to stress corrosion cracking and pitting corrosion that surpasses that of highly alloyed Cr—Ni—Mo austenites.

The effects of the respective elements individually and in interaction with the other alloy constituents are described in more detail below.

Carbon (C) may be present in a steel alloy according to the invention in amounts of up to about 0.35% by weight. Carbon is an austenite former and has a favorable effect with respect to high mechanical characteristics. As far as avoiding carbide precipitations is concerned, it is preferred to adjust the carbon content to about 0.01% by weight to about 0.06% by weight, particularly in the case of relatively large dimensions.

Silicon (Si) is provided in contents up to about 0.75% by weight and is mainly used for a deoxidation of the steel. Contents of higher than about 0.75% by weight may be disadvantageous with respect to a development of inter-metallic phases. Moreover, silicon is a ferrite former, and the silicon content should be not higher than about 0.75% by weight also for this reason. It is favorable and therefore preferred to provide silicon contents of from about 0.15% by weight to about 0.30% by weight, because a sufficient deoxidizing effect in combination with a low silicon contribution to ferrite formation is provided by this range.

Manganese (Mn) is provided in amounts of more than about 19.0% by weight and up to about 30.0% by weight. Manganese contributes substantially to a high nitrogen solubility. Pore-free materials made of a steel alloy according to the present invention can therefore also be produced with solidification under atmospheric pressure. With regard to the nitrogen solubility of an alloy in the molten state as well as during and after solidification, it is preferred to use manganese in amounts of more than about 20% by weight. Moreover, particularly with high forming degrees, manganese stabilizes the austenite structure against the formation of deformation martensite. A preferred good corrosion resistance is provided by a manganese content of up to about 25.5% by weight.

Chromium (Cr) should be present in amounts of about 17.0% by weight or more to provide high corrosion resistance. Moreover, chromium permits the incorporation of large amounts of nitrogen into the alloy. Contents of higher than about 24.0% by weight may have an adverse effect on the magnetic permeability, because chromium is one of the ferrite-stabilizing elements. Chromium contents of about 19.0% to about 23.5%, preferably about 20.0% to about 23.0% are particularly advantageous. The tendency to form chromium-containing precipitations and the resistance to pitting corrosion and stress corrosion cracking are at an optimum with these contents.

Molybdenum (Mo) is an element that contributes substantially to corrosion resistance in general and to pitting corrosion resistance in particular in a steel alloy according to the invention, where the effect of molybdenum in a content range of more than about 1.90% by weight is intensified by a presence of nickel. An optimal and therefore preferred range of the molybdenum content with respect to corrosion resistance starts at about 2.05% by weight, a particularly preferred range by starts at about 2.5% by weight. Since on the one hand molybdenum is an expensive element and on the other hand the tendency to form inter-metallic phases increases with higher molybdenum contents, the molybdenum content should not exceed about 5.5% by weight. In preferred variants of the invention Mo should not exceed about 5.0% by weight, in particular not exceed about 4.5% by weight.

Tungsten (W) may be present in concentrations of up to about 2.0% by weight and help to increase corrosion resistance. If a substantially precipitation-free alloy is required, it is expedient to keep the tungsten content in the range of from about 0.05% to about 0.2% by weight. In order to suppress inter-metallic or nitrogenous and/or carbide precipitations of tungsten or tungsten and molybdenum, it is favorable if the total content X (in % by weight) of these elements, calculated according to X=[(% molybdenum)+0.5*(% tungsten)], is greater than about 2 and smaller than about 5.5.

It has been found that in a content range of from more than about 2.50% by weight to about 15.0% by weight and in interaction with the other alloying elements nickel (Ni) contributes actively and positively to corrosion resistance. In particular, and this should be considered a complete surprise from the point of view of those skilled in the art, if more than about 2.50% by weight of nickel is present, a high stress-corrosion cracking resistance is provided. Contrary to the opinion set forth in pertinent text books and specialist works that with increasing nickel contents the stress corrosion cracking resistance of chromiferous austenites in chloride-containing media drops dramatically and at approx. 20% by weight reaches a minimum (see, e.g., A. J. Sedriks, *Corrosion of Stainless Steels*, $2^{nd}$ Edition, John Wiley & Sons Inc., 1996, page 276), a high stress corrosion cracking resistance can be achieved in a steel alloy according to the present invention even with nickel contents of more than about 2.50% by weight up to about 15.0% by weight in chloride-containing media.

No confirmed scientific explanation of this effect is yet available. Without wishing to be bound by any theory, the following is assumed: a planar dislocation arrangement is necessary for a development of trans-crystalline stress corrosion cracking through sliding events, which arrangement is benefited by a low stacking fault energy. In an alloy according to the invention, nickel increases the stacking fault energy. With more than about 2.50% by weight of nickel, this leads to high stacking fault energies and to dislocation coils, through which a susceptibility to stress corrosion cracking is reduced. In this regard, nickel contents of at least about 2.65% by weight, preferably at least about 3.6% by weight, in particular at least about 3.8% by weight and up to about 9.8% by weight are particularly preferred.

Cobalt (Co) may be provided in contents of up to about 5.0% by weight to replace nickel. However, due to the high cost of this element alone, it is preferred to keep the cobalt content below about 0.2% by weight.

As set forth above, nickel makes a great contribution to corrosion resistance and is a powerful austenite former. In contrast, although molybdenum also makes a substantial contribution to corrosion resistance, it is a ferrite former. It is therefore favorable if the nickel content is the same as or greater than the molybdenum content. In this regard it is particularly favorable if the nickel content is more than about 1.3 times, preferably more than about 1.5 times the molybdenum content.

Nitrogen (N) is beneficial in contents of from about 0.35% by weight to about 1.05% by weight in order to ensure a high strength. Furthermore, nitrogen contributes to corrosion resistance and is a powerful austenite former, which is why contents higher than about 0.40% by weight, in particular higher than about 0.60% by weight, are favorable. On the other hand, the tendency to form nitrogenous precipitations, e.g., $Cr_2N$, increases with increasing nitrogen content. In advantageous variants of the invention the nitrogen content therefore is not higher than about 0.95% by weight, preferably not higher than about 0.90% by weight.

It has proven advantageous for the ratio of the weight ratio of nitrogen to carbon to be greater than about 15, because in this case a formation of purely carbide-containing precipitations, which have an extremely adverse effect on the corrosion resistance of the material, can be at least largely eliminated.

Boron (B) can be provided in contents of up to about 0.005% by weight. In particular in a range of from about 0.0005% by weight to about 0.004% by weight, boron promotes the hot workability of a material according to the present invention.

Copper (Cu) can usually be tolerated in a steel alloy according to the invention in an amount of less than about 0.5% by weight. In amounts of from about 0.04% by weight to about 0.35% by weight copper proves to be thoroughly advantageous for special uses of drill rods, e.g., when drill rods come in contact with media such as hydrogen sulfides, in particular $H_2S$, during drilling. Cu contents of higher than about 0.5% by weight promote a precipitation formation and may be a disadvantageous with respect to corrosion resistance.

In addition to silicon, aluminum (Al) contributes to a deoxidation of the steel, but also is a powerful nitride former, which is why this element should preferably not be present in amounts which exceed about 0.05% by weight.

Sulfur (S) is provided in contents up to about 0.30% by weight. Contents higher than about 0.1% by weight have a very favorable effect on the processing of a steel alloy according to the invention, because machining is facilitated. However, if the emphasis is on a maximum corrosion resistance of the material, the sulfur content should preferably not be higher than about 0.015% by weight.

In a steel alloy according to the present invention, the content of phosphorus (P) is lower than about 0.035% by weight. Preferably, the phosphorus content does not exceed about 0.02% by weight.

Vanadium (V), niobium (Nb), and titanium (Ti) have a grain-refining effect in steel and to this end can be present individually or in any combination, with the total concentration of these elements being usually not higher than about 0.85% by weight. With respect to a grain-refining effect and the avoidance of coarse precipitations of these powerful carbide formers, it is advantageous if the total concentration of these elements is higher than about 0.08% by weight and lower than about 0.45% by weight.

In a steel alloy according to the present invention, the elements tungsten, molybdenum, manganese, chromium, vanadium, niobium and titanium make a positive contribution to the solubility of nitrogen.

It is particularly favorable if a semi-finished product made of an alloy according to the present invention is hot worked at a temperature of more than about 750° C., optionally solution-annealed and quenched, and subsequently formed at a temperature below the recrystallization temperature, preferably below about 600° C., in particular in the temperature range of from about 300° C. to about 500° C. In this state of the material, a microstructure is present that is essentially free of nitrogenous and/or carbide precipitations. A homogenous, fine austenitic microstructure without deformation martensite can be achieved by using the specified procedural steps. Materials processed in this way will usually have a fatigue strength under reversed stresses at room temperature of more than about 400 MPa at $10^7$ load alternation.

An alloy according to the invention may particularly advantageously be used for components that are subjected to tensile and compressive stresses and which come in contact with corrosive media, in particular a corrosive fluid such as saline water. The advantages of such a use include that wear due to chemical corrosion is retarded and the components or parts have an increased working life when the specified alloys are used.

When further processing a rod-shaped material made of an alloy according to the invention to form drill rods by turning and peeling, it has surprisingly been found that the wear of turning or peeling tools is substantially reduced compared with materials according to the prior art.

Pursuant to this aspect, the present invention provides a method for producing austenitic, substantially ferrite-free components for oilfield technology with which in particular, drill rods with high corrosion resistance and lower tool wear can be produced in a cost-effective manner.

The method of the invention comprises the production of a cast piece which comprises, in percent by weight:

from about 0% to about 0.35% of carbon
from about 0% to about 0.75% of silicon
from more than about 19.0% to about 30.0% of manganese
from more than about 17.0% to about 24.0% of chromium
from more than about 1.90% to about 5.5% of molybdenum
from about 0% to about 2.0% of tungsten
from about 0% to about 15.0% of nickel
from about 0% to about 5.0% of cobalt
from about 0.35% to about 1.05% of nitrogen
from about 0% to about 0.005% of boron
from about 0% to about 0.30% of sulfur
from about 0% to less than about 0.5% of copper
from about 0% to less than about 0.05% of aluminum
from about 0% to less than about 0.035% of phosphorus, the total content of nickel and cobalt being greater than about 2.50%, and optionally one or more elements selected from vanadium, niobium and titanium in a total concentration of not more than about 0.85%, balance iron and production-related impurities.

This cast piece is formed into a semi-finished product at a temperature of above about 750° C. in several hot working partial steps. A homogenization of the semi-finished product at a temperature of above about 1150° C. is optionally carried out before the first partial step or between the partial steps, whereupon, after the last hot-working partial step and an optional solution annealing of the semi-finished product at a temperature of above about 900° C., the semi-finished product is subjected to an intensified cooling and is formed in a further forming step at a temperature below the recrystallization temperature, in particular below about 600° C. Thereafter a component is made from the semi-finished product by machining.

The advantages achieved with such a method include that components for oilfield technology which have improved corrosion resistance with mechanical properties sufficient for end uses can be produced with a tool wear that is reduced by up to about 12%. The optional homogenization can be undertaken both before the first hot-working step and after a first hot-working step, but before a second hot-working step.

Higher temperatures facilitate a forming in the forming step after an intensified cooling and it is therefore favorable if the forming step is carried out at a temperature of the semi-finished product of above about 350° C.

If the component to be produced is a drill rod, the semi-finished product is expediently a rod which is formed in the second forming step with a deformation degree of about 10% to about 20%. Such deformation degrees produce an adequate strength for end uses and permit a turning or peeling processing with reduced tool wear.

With respect to the quality of produced components, it has proven to be favorable if an ingot is produced by means of an electroslag remelting process.

A quick and cost-effective production of components is rendered possible if the machining comprises a turning and/or peeling.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description making apparent to those skilled in the art how the several forms of the present invention may be embodied in practice.

Ingots were produced by melting under atmospheric pressure. The chemical compositions of the ingots correspond to alloys 1 through 5 and 7 in Table 1. A cast piece of alloy 6 in Table 1 was remelted under a nitrogen atmosphere at 16 bar pressure and nitrogenized. The pore-free ingots were subsequently homogenized at 1200° C. and hot worked at 910° C. with a deformation degree of 75% [deformation degree= ((starting cross section—ending cross section)/starting cross section)*100]. This was followed by a solution annealing treatment between 1000° C. and 1100° C. Subsequently the ingots formed into semi-finished products were quenched with water to ambient temperature and finally subjected to a second forming step at a temperature of 380° C. to 420° C., where the deformation degree was 13% to 17%. The articles thus produced were tested or further processed into drill rods.

Alloys A, B, C, D and E, the compositions whereof are also shown in Table 1, represent commercially available products. For comparative purposes articles made of these alloys were likewise tested or processed.

TABLE 1

Chemical compositions of comparison alloys A through E and alloys 1 through 7 according to the invention (data in % by weight)

| Alloy | C | Si | Mn | P | S | Cr | Mo | Ni | V | W | Cu | Co | Ti | Al | Nb | B | Fe | N |
|---|---|---|---|---|---|---|---|---|---|---|---|---|---|---|---|---|---|---|
| A | 0.03 | 0.5 | 19.8 | <0.05 | <0.015 | 13.5 | 0.5 | 1.1 | 0.1 | 0.2 | 0.1 | 0.1 | <0.1 | <0.01 | <0.1 | <0.005 | Bal. | 0.30 |
| B | 0.05 | 0.3 | 19.9 | <0.05 | <0.015 | 18.2 | 0.3 | 1.0 | 0.1 | 0.2 | 0.1 | 0.1 | <0.1 | <0.01 | <0.1 | <0.005 | Bal. | 0.60 |
| C | 0.04 | 0.2 | 23.6 | <0.05 | <0.015 | 21.4 | 0.3 | 1.6 | 0.1 | 0.2 | 0.1 | 0.1 | <0.1 | <0.01 | <0.1 | <0.005 | Bal. | 0.87 |
| D | 0.01 | 0.3 | 2.7 | <0.05 | <0.015 | 27.3 | 3.2 | 29.4 | 0.1 | 0.1 | 0.6 | 0.1 | <0.1 | <0.01 | <0.1 | <0.005 | Bal. | 0.29 |
| E | 0.01 | <0.05 | 0.1 | <0.005 | <0.001 | 20.6 | 3.1 | Bal. | 0.02 | <0.05 | 1.8 | <0.05 | 2.1 | 0.2 | 0.3 | 0.003 | 27.8 | <0.01 |
| 1 | 0.04 | 0.2 | 19.8 | <0.035 | <0.015 | 18.8 | 1.94 | 3.9 | 0.07 | 0.1 | 0.1 | 0.1 | <0.1 | <0.01 | <0.1 | <0.005 | Bal. | 0.62 |
| 2 | 0.04 | 0.2 | 21.4 | <0.035 | <0.015 | 18.5 | 2.13 | 5.8 | 0.10 | 0.1 | 0.1 | 0.1 | <0.1 | <0.01 | <0.1 | <0.005 | Bal. | 0.60 |
| 3 | 0.04 | 0.2 | 23.3 | <0.035 | <0.015 | 20.7 | 2.03 | 4.5 | 0.05 | 0.1 | 0.2 | 0.1 | <0.1 | <0.01 | <0.1 | <0.005 | Bal. | 0.88 |
| 4 | 0.03 | 0.2 | 24.4 | <0.035 | <0.015 | 21.0 | 3.15 | 6.5 | 0.10 | 0.1 | 0.3 | 0.1 | <0.1 | <0.01 | <0.1 | <0.005 | Bal. | 0.86 |
| 5 | 0.04 | 0.2 | 25.2 | <0.035 | 0.0020 | 20.9 | 4.11 | 9.3 | 0.03 | 0.1 | 0.1 | 0.1 | <0.1 | <0.01 | <0.1 | <0.005 | Bal. | 0.78 |
| 6 | 0.15 | 0.5 | 19.3 | <0.035 | <0.015 | 18.2 | 2.05 | 2.7 | 0.01 | 0.1 | 0.1 | 0.1 | <0.1 | <0.01 | 0.1 | <0.005 | Bal. | 0.77 |
| 7 | 0.34 | 0.1 | 22.4 | <0.035 | <0.015 | 17.4 | 2.5 | 4.0 | 0.02 | 0.1 | 0.1 | 0.1 | <0.1 | <0.01 | <0.1 | <0.005 | Bal. | 0.52 |

The alloys listed in Table 1 were tested with regard to pitting corrosion resistance and stress corrosion cracking. The pitting corrosion resistance was determined by measuring the pitting corrosion potential relative to a standard hydrogen electrode according to ASTM G 61. The stress corrosion cracking (SCC) was established by determining the value of the SCC limiting stress according to ASTM G 36. The value of the SCC limiting stress represents the maximum test stress applied externally which a test specimen withstood for more than 720 hours in a 45% $MgCl_2$ solution at 155° C.

Tests on articles made of the alloys listed in Table 1 demonstrate an outstanding corrosion resistance combined with high mechanical characteristics of materials according to the invention. Table 2 and Table 3 show that alloys according to the invention are much more corrosion-resistant with good mechanical properties compared to above all the Cr—Mn austenites known from the prior art (alloys A, B and C). An increased resistance of alloys according to the invention to pitting corrosion as well as stress-corrosion cracking is thereby evident.

The pitting potential $E_{pit}$ or the SCC limiting stress can even reach values which correspond to those of highly alloyed Cr—Ni—Mo steels and nickel-based alloys, while at the same time better strength properties are provided, as shown by Tables 4 and 5. With respect to the SCC limiting stress it is thereby particularly favorable if the total content of molybdenum and nickel is about 4.7% by weight or more, in particular more than about 6% by weight.

TABLE 2

Pitting potential $E_{pit}$ (each relative to a standard hydrogen electrode) of comparison alloys A through E and alloys 1 through 7 according to the invention

| Alloy | PREN value* | Pitting potential $E_{pit}$: Test A (25° C., 80,000 ppm $Cl^-$) | Pitting potential $E_{pit}$: Test B (60° C., synthetic sea water) |
|---|---|---|---|
| A | 20.0 | <0 | <0 |
| B | 28.8 | 164 | <0 |
| C | 36.3 | 527 | 49 |
| D | 42.5 | no pitting | 1,142 |
| E | 30.8 | no pitting | 733 |
| 1 | 35.1 | 558 | 65 |
| 2 | 35.0 | 563 | 77 |
| 3 | 41.3 | no pitting | 671 |
| 4 | 45.3 | no pitting | 1,091 |
| 5 | 46.9 | no pitting | 1,188 |
| 6 | 37.3 | no pitting | 645 |
| 7 | 34.0 | no pitting | 598 |

*PREN = pitting resistance equivalent number
(PREN = % by weight Cr + 3.3*% by weight Mo + 16*% by weight N)

TABLE 3

Stress corrosion cracking (SCC) limiting stress in magnesium chloride (solution-annealed and cold worked state of the alloys)

| Alloy | Mo content [% by weight] | Ni content [% by weight] | Σ(% Ni + % Mo) [% by weight] | SCC limiting stress [MPa] |
|---|---|---|---|---|
| A | 0.5 | 1.1 | 1.6 | 250 |
| B | 0.3 | 1.0 | 1.3 | 325 |
| C | 0.3 | 1.6 | 1.9 | 375 |
| D | 3.2 | 29.4 | 32.6 | 550 |
| E | 3.1 | Bal. | 47.1 | 850 |
| 1 | 1.94 | 3.9 | 5.8 | 450 |
| 2 | 2.13 | 5.8 | 7.9 | 475 |
| 3 | 2.03 | 4.5 | 6.5 | 500 |
| 4 | 3.15 | 6.5 | 9.7 | 525 |
| 5 | 4.11 | 9.3 | 13.4 | 550 |
| 6 | 2.05 | 2.7 | 4.7 | 450 |
| 7 | 2.5 | 4.0 | 6.5 | 475 |

TABLE 4

Mechanical properties and grain size of comparison alloys A through E and alloys 1 through 7 according to the invention in solution-annealed state

| Alloy | Mechanical Properties: 0.2% Yield strength $R_{p0.2}$ [MPa] | Tensile strength $R_m$ [MPa] | Elongation at break $A_5$ [%] | Notched impact work $A_V$ [J] | ASTM grain size |
|---|---|---|---|---|---|
| A | 405 | 725 | 55 | 305 | 3- 6 |
| B | 515 | 845 | 52 | 350 | |
| C | 599 | 942 | 48 | 325 | |
| D | 445 | 790 | 63 | 390 | |
| E | 310 | 672 | 75 | 335 | |

TABLE 4-continued

Mechanical properties and grain size of comparison alloys A through E and alloys 1 through 7 according to the invention in solution-annealed state

| Alloy | Mechanical Properties: 0.2% Yield strength $R_{p0.2}$ [MPa] | Tensile strength $R_m$ [MPa] | Elongation at break $A_5$ [%] | Notched impact work $A_V$ [J] | ASTM grain size |
|---|---|---|---|---|---|
| 1 | 507 | 843 | 50 | 289 | 4- 5 |
| 2 | 497 | 829 | 50 | 293 | |
| 3 | 598 | 944 | 51 | 303 | |
| 4 | 571 | 928 | 53 | 301 | |
| 5 | 564 | 903 | 54 | 295 | |
| 6 | 582 | 930 | 52 | 355 | |
| 7 | 550 | 925 | 54 | 378 | |

TABLE 5

Mechanical properties of comparison alloys A through E and alloys 1 through 7 according to the invention in solution-annealed and cold-worked state

| Alloy | Mechanical Properties: 0.2% Yield strength $R_{p0.2}$ [MPa] | Tensile strength $R_m$ [MPa] | Elongation at break $A_5$ [%] | Notched impact work $A_V$ [J] | Cold working degree [%] |
|---|---|---|---|---|---|
| A | 825 | 915 | 30 | 225 | 10- 30 |
| B | 1,015 | 1,120 | 25 | 190 | 20- 30 |
| C | 1,120 | 1,229 | 23 | 145 | not |
| D | 982 | 1,089 | 21 | 210 | determined |
| E | 1,015 | 1,190 | 23 | 70 | |
| 1 | 1,021 | 1,128 | 24 | 195 | 13- 17 |
| 2 | 996 | 1,097 | 24 | 183 | |
| 3 | 1,117 | 1,230 | 22 | 147 | |
| 4 | 1,103 | 1,215 | 22 | 152 | |
| 5 | 1,077 | 1,192 | 23 | 156 | |
| 6 | 1,112 | 1,226 | 22 | 165 | |
| 7 | 1,065 | 1,195 | 23 | 188 | |

Further tests showed that articles made of alloys 1 through 7 according to the invention have a relative magnetic permeability of $\mu_{r<1.005}$ and a fatigue strength under reversed stresses at room temperature of at least 400 MPa at $10^7$ load alternation.

When producing drill rods, in machining a rod-shaped material of alloy C and materials of alloys 3 and 4, indexable tips could be used in the processing of alloys 3 and 4 by 12% longer than in the processing of rods made of alloy C. Drill rods that have high mechanical characteristics and an improved corrosion resistance can thus be produced with lower tool wear.

Due to the combination of maximum strength with good toughness and optimum corrosion properties, an alloy according to the invention is also optimally suitable as a material for fastening or connecting elements such as screws, nails, bolts and the like components when these elements are subjected to high mechanical stresses and aggressive environmental conditions.

Another field of application in which alloys according to the invention can be used advantageously is the area of parts which are subject to corrosion and wear, such as baffle plates or parts that are exposed to high stress speeds. Due to their combination of properties, components made of alloys according to the invention can achieve a minimum material wear and thus a maximum service life in these fields of application.

It is noted that the foregoing examples have been provided merely for the purpose of explanation and are in no way to be construed as limiting of the present invention. While the present invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The disclosures of all documents referred to herein, in particular, of the documents referred to in paragraphs [0010] to [0012], [0051] and [0078] are expressly incorporated by reference herein in their entireties.

What is claimed is:

1. A component for use in oil field technology, wherein the component comprises a drilling string part and is made of a material which comprises an austenitic, substantially ferrite-free steel alloy comprising, in % by weight:

from about 0% to about 0.35% of carbon
from about 0% to about 0.75% of silicon
from more than about 20.0% to about 30.0% of manganese
from more than about 17.0% to about 24.0% of chromium
from more than 1.90% to about 5.5% of molybdenum
from about 0% to about 2.0% of tungsten
from 3.6% to about 15.0% of nickel
from about 0% to about 5.0% of cobalt
from 0.60% to about 1.05% of nitrogen
from about 0% to about 0.005% of boron
from about 0% to about 0.30% of sulfur
from about 0% to less than about 0.5% of copper
from about 0% to less than about 0.05% of aluminum
from about 0% to less than about 0.035% of phosphorus,
and optionally one or more elements selected from vanadium, niobium and titanium in a total concentration of not more than about 0.85%, balance iron and production-related impurities, and wherein the drilling string part has a fatigue strength under reversed stresses at room temperature of greater than about 400 MPa at $10^7$ load alternation.

2. The component of claim 1, wherein the alloy comprises at least 3.8% of nickel.

3. The component of claim 1, wherein the alloy comprises from about 3.8% to about 9.8% of nickel.

4. The component of claim 1, wherein the alloy comprises not more than about 0.2% of cobalt.

5. The component of claim 1, wherein the alloy comprises from about 2.05% to about 5.0% of molybdenum.

6. The component of claim 5, wherein the alloy comprises from about 2.5% to about 4.5% of molybdenum.

7. The component of claim 1, wherein the alloy comprises from more than about 20.0% to about 25.5% of manganese.

8. The component of claim 1, wherein the alloy comprises from about 19.0% to about 23.5% of chromium.

9. The component of claim 8, wherein the alloy comprises from about 20.0% to about 23.0% of chromium.

10. The component of claim 1, wherein the alloy comprises from about 0.15% to about 0.30% of silicon.

11. The component of claim 1, wherein the alloy comprises from about 0.01% to 0.06% of carbon.

12. The component of claim 1, wherein the alloy comprises up to about 0.95% of nitrogen.

13. The component of claim 12, wherein the alloy comprises up to about 0.90% of nitrogen.

14. The component of claim 1, wherein a weight ratio of nitrogen to carbon is greater than 15.

15. The component of claim 1, wherein the alloy comprises from about 0.04% to about 0.35% of copper.

16. The component of claim 1, wherein the alloy comprises from about 0.0005% to about 0.004% of boron.

17. The component of claim 1, wherein a concentration of nickel is about equal to or greater than a concentration of molybdenum.

18. The component of claim 1, wherein a concentration of nickel is greater than about 1.3 times a concentration of molybdenum.

19. The component of claim 18, wherein a concentration of nickel is greater than about 1.5 times a concentration of molybdenum.

20. The component of claim 1, wherein the alloy comprises at least two elements selected from vanadium, niobium and titanium in a total concentration of from higher than about 0.08% to lower than about 0.45%.

21. The component of claim 1, wherein X=[(% molybdenum)+0.5*(% tungsten)] and X is greater than about 2 and smaller than about 5.5.

22. The component of claim 1, wherein the alloy comprises:

at least 3.8% of nickel
not more than about 0.2% of cobalt
from 2.05% to about 5.0% of molybdenum
from more than about 20.0% to about 25.5% of manganese
from about 19.0% to about 23.5% of chromium
from about 0.15% to about 0.30% of silicon
from about 0.01% to about 0.06% of carbon
from 0.60% to about 0.95% of nitrogen
from about 0.04% to about 0.35% of copper
from about 0.0005% to about 0.004% of boron
not more than about 0.015% of sulfur
not more than about 0.02% of phosphorus.

23. The component of claim 1, wherein the alloy comprises:

from about 3.8% to about 9.8% of nickel
not more than about 0.2% of cobalt
from about 2.5% to about 4.5% of molybdenum
from more than about 20.0% to about 25.5% of manganese
from about 20.0% to about 23.0% of chromium
from about 0.15% to about 0.30% of silicon
from about 0.01% to about 0.06% of carbon
from 0.60% to about 0.90% of nitrogen
from about 0.04% to about 0.35% of copper
from about 0.0005% to about 0.004% of boron
not more than about 0.015% of sulfur
not more than about 0.02% of phosphorus.

24. The component of claim 1, wherein the alloy is substantially free of at least one of nitrogenous precipitations and carbide precipitations.

25. The component of claim 1, wherein the alloy has been hot worked at a temperature of higher than about 750° C., solution-annealed and subsequently worked at a temperature below a recrystallization temperature.

26. A component for use in oilfield technology, wherein the component has a fatigue strength under reversed stresses at room temperature of greater than about 400 MPa at $10^7$ load alternation and has been obtained by a process which comprises:

(a) forming a cast piece of an alloy into a semi-finished product in two or more hot working partial operations at a temperature of above about 750° C., the alloy comprising, in % by weight:

from about 0% to about 0.35% of carbon
from about 0% to about 0.75% of silicon
from more than about 20.0% to about 30.0% of manganese
from more than about 17.0% to about 24.0% of chromium
from more than 1.90% to about 5.5% of molybdenum
from about 0% to about 2.0% of tungsten
from 3.6% to about 15.0% of nickel
from about 0% to about 5.0% of cobalt
from about 0.60% to about 1.05% of nitrogen
from about 0% to about 0.005% of boron
from about 0% to about 0.30% of sulfur
from about 0% to less than about 0.5% of copper
from about 0% to less than about 0.05% of aluminum
from about 0% to less than about 0.035% of phosphorus,
and optionally one or more elements selected from vanadium, niobium and titanium in a total concentration of not more than about 0.85%, balance iron and production-related impurities, (b) subjecting the semi-finished product to intensified cooling, and (c) working the cooled semi-finished product at a temperature below a recrystallization temperature.

27. The component of claim 26, wherein the semi-finished product of (c) further is subjected to a process which comprises machining.

28. The component of claim 26, wherein at least one of before a first hot working partial operation and between two subsequent hot working partial operations a homogenization of the semi-finished product is carried out at a temperature of above about 1150° C.

29. The component of claim 28, wherein after the last hot working partial operation a solution annealing of the semi-finished product at a temperature of above about 900° C. is carried out.

30. The component of claim 26, wherein (c) is carried out at a temperature of below about 600° C.

31. The component of claim 30, wherein (c) is carried out at a temperature of above about 350° C.

32. The component of claim 26, wherein (c) is carried out at a temperature of not higher than about 550° C.

33. The component of claim 26, wherein the semi-finished product comprises a drilling string part.

34. The component of claim 26, wherein the semi-finished product comprises a rod.

35. The component of claim 34, wherein the rod is worked in (c) with a deformation degree of from about 10% to about 20%.

36. The component of claim 35, wherein the rod is worked in (c) at a temperature of below about 600° C.

37. The component of claim 26, wherein the cast piece has been produced by a process which comprises an electroslag remelting process.

38. The component of claim 27, wherein the machining comprises at least one of a turning and a peeling.

39. The component of claim 26, wherein the component is capable of withstanding tensile and compressive stresses in a corrosive fluid.

40. The component of claim 39, wherein the corrosive fluid comprises saline water.

41. A component for use in oilfield technology, wherein the component has a fatigue strength under reversed stresses at room temperature of greater than about 400 MPa at $10^7$ load alternation and has been obtained by a process which comprises:

(a) forming a cast piece of an alloy into a semi-finished product in two or more hot working partial operations at a temperature of above about 750° C., the alloy comprising, in % by weight:

from about 0% to about 0.35% of carbon
from about 0% to about 0.75% of silicon
from more than about 20.0% to about 30.0% of manganese
from more than about 17.0% to about 24.0% of chromium
from more than 1.90% to about 5.5% of molybdenum
from about 0% to about 2.0% of tungsten
from about 3.8% to about 15.0% of nickel
from about 0% to about 5.0% of cobalt
from about 0.60% to about 1.05% of nitrogen
from about 0% to about 0.005% of boron
from about 0% to about 0.30% of sulfur
from about 0% to less than about 0.5% of copper
from about 0% to less than about 0.05% of aluminum
from about 0% to less than about 0.035% of phosphorus,
and optionally one or more elements selected from vanadium, niobium and titanium in a total concentration of not more than about 0.85%, balance iron and production-related impurities, (b) subjecting the semi-finished product to intensified cooling, (c) working the cooled semi-finished product at a temperature of below about 600° C. with a deformation degree of from about 10% to about 20%; and (d) subjecting the semi-finished product of (c) to a process which comprises machining.

42. A component for use in oil field technology, wherein the component comprises a drilling string part and is made of a material which comprises an austenitic, substantially ferrite-free steel alloy comprising, in % by weight:

from about 0% to about 0.35% of carbon
from about 0% to about 0.75% of silicon
from more than about 20.0% to about 30.0% of manganese
from more than about 17.0% to about 24.0% of chromium
from more than 1.90% to about 5.5% of molybdenum
from about 0% to about 2.0% of tungsten
from 3.6% to about 15.0% of nickel
from about 0% to about 5.0% of cobalt
from 0.60% to about 1.05% of nitrogen
from about 0% to about 0.005% of boron
from about 0% to about 0.30% of sulfur
from about 0% to less than about 0.5% of copper
from about 0% to less than about 0.05% of aluminum
from about 0% to less than about 0.035% of phosphorus,
and optionally one or more elements selected from vanadium, niobium and titanium in a total concentration of not more than about 0.85%, balance iron and production-related impurities, and wherein the alloy has been hot worked at a temperature of higher than about 750° C., solution-annealed and subsequently worked at a temperature below a recrystallization temperature.

43. The component of claim 42, wherein the alloy comprises at least 3.8% of nickel.

44. The component of claim 42, wherein the alloy comprises from about 3.8% to about 9.8% of nickel.

45. The component of claim 42, wherein the alloy comprises not more than about 0.2% of cobalt.

46. The component of claim 42, wherein the alloy comprises from about 2.05% to about 5.0% of molybdenum.

47. The component of claim 42, wherein the alloy comprises from about 2.5% to about 4.5% of molybdenum.

48. The component of claim 42, wherein the alloy comprises from more than about 20.0% to about 25.5% of manganese.

49. The component of claim 42, wherein the alloy comprises from about 19.0% to about 23.5% of chromium.

50. The component of claim 49, wherein the alloy comprises from about 20.0% to about 23.0% of chromium.

51. The component of claim 42, wherein the alloy comprises from about 0.15% to about 0.30% of silicon.

52. The component of claim 42, wherein the alloy comprises from about 0.01% to 0.06% of carbon.

53. The component of claim 42, wherein the alloy comprises up to about 0.95% of nitrogen.

54. The component of claim 42, wherein the alloy comprises from about 0.04% to about 0.35% of copper.

55. The component of claim 42, wherein the alloy comprises from about 0.0005% to about 0.004% of boron.

56. The component of claim 42, wherein the alloy comprises:

at least 3.8% of nickel
not more than about 0.2% of cobalt
from 2.05% to about 5.0% of molybdenum
from more than about 20.0% to about 25.5% of manganese
from about 19.0% to about 23.5% of chromium
from about 0.15% to about 0.30% of silicon
from about 0.01% to about 0.06% of carbon
from 0.60% to about 0.95% of nitrogen
from about 0.04% to about 0.35% of copper
from about 0.0005% to about 0.004% of boron
not more than about 0.015% of sulfur
not more than about 0.02% of phosphorus.

57. The component of claim 42, wherein the alloy comprises:

from about 3.8% to about 9.8% of nickel
not more than about 0.2% of cobalt
from about 2.5% to about 4.5% of molybdenum
from more than about 20.0% to about 25.5% of manganese
from about 20.0% to about 23.0% of chromium
from about 0.15% to about 0.30% of silicon
from about 0.01% to about 0.06% of carbon
from 0.60% to about 0.90% of nitrogen
from about 0.04% to about 0.35% of copper
from about 0.0005% to about 0.004% of boron
not more than about 0.015% of sulfur
not more than about 0.02% of phosphorus.

58. The component of claim 42, wherein the alloy has been worked at a temperature below about 600° C.

59. The component of claim 42, wherein the alloy has been worked at a temperature of from about 300° C. to about 550° C.

* * * * *